United States Patent [19]

Suzuki et al.

[11] Patent Number: 4,825,221

[45] Date of Patent: Apr. 25, 1989

[54] DIRECTLY EMITTING DIELECTRIC TRANSMISSION LINE

[75] Inventors: Hirosuke Suzuki, Tokorozawa; Hiromi Yasumoto, Hitaka; Haruo Imaizumi, Nishi-Asuma, all of Japan

[73] Assignee: Junkosha Co., Ltd., Tokyo, Japan

[21] Appl. No.: 129,241

[22] Filed: Dec. 7, 1987

Related U.S. Application Data

[63] Continuation of Ser. No. 818,730, Jan. 14, 1986, abandoned.

[30] Foreign Application Priority Data

Jan. 16, 1985 [JP] Japan ..... 60-3981

[51] Int. Cl.[4] ..... H01Q 13/08

[52] U.S. Cl. ..... 343/785; 333/239; 333/242

[58] Field of Search ..... 343/785, 753, 772, 755, 343/786, 905; 333/237, 236, 239, 240, 242

[56] References Cited

U.S. PATENT DOCUMENTS

| | | | |
|---|---|---|---|
| 3,128,467 | 4/1964 | Lanctot | 343/785 |
| 3,414,903 | 12/1968 | Bartlett et al. | 343/753 |
| 3,434,774 | 3/1969 | Miller | 343/785 |
| 3,435,458 | 3/1969 | Lewis | 343/785 |
| 3,703,690 | 11/1972 | Ravenscroft et al. | 333/240 |
| 3,953,566 | 4/1976 | Gore | 264/175 |
| 4,441,091 | 4/1984 | Nishida et al. | 333/242 |

FOREIGN PATENT DOCUMENTS

| | | | |
|---|---|---|---|
| 2106607 | 9/1971 | Fed. Rep. of Germany | 333/239 |
| 1190397 | 10/1959 | France | 343/785 |
| 570038 | 6/1945 | United Kingdom | 343/785 |

OTHER PUBLICATIONS

"Dielectric Tapered Rod Antennas for Millimeter-Wave Applications", Kobayashi et al., IEEE Trans. on Antennas and Prop., vol. AP-30, No. 1, Jan. 1982, pp. 54–58.

*Primary Examiner*—William L. Sikes
*Assistant Examiner*—Michael C. Wimer
*Attorney, Agent, or Firm*—Mortenson & Uebler

[57] ABSTRACT

Means are provided for radiating electromagnetic waves from a receiving end zone of a dielectric line for transmitting electromagnetic waves without the need for a metal horn antenna or a metal waveguide, and matching problems are thereby substantially avoided. Said means are provided by shaping the end of the line to specified contours, by varying the dielectric constant of the material of the line in a gradient longitudinally near the end zone of the line, and by arranging a reflecting mirror or lens to receive the waves emitted from the line. This waveguide is useful in wireless communications, radar transmission and similar applications.

5 Claims, 2 Drawing Sheets

$$\varepsilon_1 > \varepsilon_2 > \varepsilon_3 > \varepsilon_4$$

$$\varepsilon'_1 > \varepsilon'_2 > \varepsilon'_3 > \varepsilon'_4$$

$\varepsilon_1 > \varepsilon_2 > \varepsilon_3 > \varepsilon_4$ $\varepsilon'_1 > \varepsilon'_2 > \varepsilon'_3 > \varepsilon'_4$

DIRECTLY EMITTING DIELECTRIC TRANSMISSION LINE

CROSS-REFERENCE TO RELATED APPLICATION

This application is a continuation of prior copending application Ser. No. 818,730 filed Jan. 14, 1986, now abandoned.

BACKGROUND OF THE INVENTION

The present invention relates to a dielectric line to be used for transmitting energy of electromagnetic waves such as millimetric or submillimetric waves and, more particularly, to a dielectric line equipped with means for emitting electromagnetic waves directly from one end portion thereof into space without the use of a metallic waveguide.

When a metallic waveguide is used as a guide for the passage of microwaves so that electromagnetic waves may be radiated from the end portion of a dielectric transmission line, it is current practice to attach a metallic antenna having a horned opening to the end portion. In order to radiate plane waves, systems such as a lens antenna system are used, in which the metallic antenna is used as a primary radiation antenna and a dielectric lens is used in the advancing direction of the electromagnetic waves, or a reflector antenna system in which a reflecting mirror of metal is used, or a Cassegrain antenna system, in which two reflecting mirrors are used, is employed.

In accordance with the development of a semiconductor for transmission of electromagnetic waves in the millimetric wavelength range, practical application of radio communications, radar systems and other applications have increased and a dielectric transmission line has been used as a waveguide in and between apparatus in such applications. The prior dielectric line, as indicted in its entirety at numeral 1' in FIG. 15 is constructed of a central core 2 made of a porous plastic material having a relatively high dielectric constant, and a cladding 3 coaxially enclosing the core 1' and made of a plastic material having a relatively low dielectric constant so that the electromagnetic wave energy may be confined in and propagated mainly through the core 2. Reference numeral 4 indicates an insulating protective layer covering the outer circumference of the cladding 3.

The dielectric line having the construction described above has a variety of advantages such as ease of working or connection with other parts, and ample flexibility because it has less insertion loss and a larger size for high-frequency waves than a metallic waveguide. As a result, such a dielectric line has been used more and more frequently.

When electromagnetic waves are to be radiated from the end portion of the aforementioned dielectric line, it is current practice to connect a metallic waveguide and a metal horn to the dielectric line through a connector called a "launcher". The reasons therefor are as follows:

(1) It is possible to use existing and completed electromagnetic wave radiation techniques which use a metallic waveguide and a metal horn;

(2) In the radiation or transmission of electromagnetic waves, the launcher preserves the phase center that is to be transmitted from dielectric line to a metallic waveguide or horn via the launcher;

(3) The end portion of the dielectric line can be firmly fixed because it is fixed at the position of the metallic guide tube. The electromagnetic waves in the metallic guide tube are not disturbed even if the guide tube has its outside fixed by means of a fixture, because there is no electromagnetic wave present outside of the guide tube.

If a metallic waveguide is connected to the dielectric line, however, registration of the transmission constant at the connecting portion is so difficult as to cause increase in insertion loss, the deterioration of attenuation due to reflection, the displacement of phase planes, and other problems.

If the dielectric line is twisted to change the plane of polarization, there arises another problem in that registration with the metallic waveguide deteriorates making the frequency band narrower.

Investigations of means for radiating electromagnetic waves from the end portion of a dielectric line have led to the present invention, which is characterized not by connecting a metallic waveguide as in the prior art, but by disposing, in association with one end portion of the dielectric line, means for extracting the electromagnetic waves radiated in the form of a plane front from said one end portion of the dielectric line.

SUMMARY OF THE INVENTION

A dielectric transmission line for transmitting electromagnetic waves which can be radiated from one end portion thereof into the surrounding space is provided comprising one end portion of the dielectric line being contoured to a configuration required for emitting electromagnetic waves in the form of a predetermined wave front. The dielectric line may have a convex face formed at one end portion, or a concave face formed at one end portion, or a conical end portion formed at one end portion or a flat end portion and having a lens arranged to face the flat end face of the end portion. The dielectric line may have a mirror arranged to face the end face of one end portion. In one embodiment, the wave energy transmitting portion of the dielectric line has a dielectric constant decreasing in the axial direction proceeding toward one end portion. The electromagnetic wave energy transmitting portion of the dielectric line is preferably made of unsintered or incompletely sintered expanded polytetrafluoreothylene.

BRIEF DESCRIPTION OF THE DRAWINGS

FIG. 1 shows a line having its end shaped in a convex configuration.

FIG. 2 shows an embodiment having a concave end configuration and FIG. 3 shows a conical end.

FIG. 4 shows an embodiment wherein cladding has been removed from near one end portion and the core is exposed for a distance near the end zone where it is formed to a cone shape at the end.

FIG. 5 shows an embodiment having a flat end and having decreasing dielectric constant longitudinally along the line approaching the end of the line.

FIG. 6 shows an embodiment wherein the end is conical and the dielectric constant of the core decreases moving longitudinally along the line toward the end.

FIG. 7 shows an embodiment wherein the ends of the cover and cladding are cut at right angles to the line and the core extends outwardly from the line for a distance and then comes to a conical taper at the end, the core having a longitudinally decreasing dielectric constant as the end tip is approached.

FIG. 8 shows a line having end face at a right angle to the longitudinal dimension of the line and having a convex lens positioned adjacent the end.

FIGS. 9 and 10 show embodiments wherein the end of a line such as that of FIG. 8 is positioned at the focal point of a parabolic antenna.

DETAILED DESCRIPTION OF THE INVENTION AND PREFERRED EMBODIMENTS WITH REFERENCE TO THE DRAWINGS

Means are provided for radiating electromagnetic waves from a receiving end zone of a dielectric line for transmitting electromagnetic waves without the need for a metal horn antenna or a metal waveguide, and matching problems are thereby substantially avoided. Said means are provided by shaping the end of the line to specified contours, by varying the dielectric constant of the material of the line in a gradient longitudinally near the end zone of the line, and by arranging a reflecting mirror or lens to receive the waves emitted from the line. This waveguide is useful in wireless communications, radar transmission and similar applications.

With reference to the accompanying drawings, the embodiments of the present invention will be described in detail in the following. Before this description, the specific dielectric line to be use in the following embodiments will be discussed briefly. The dielectric line was proposed in Japanese patent application No. 52-14118 (Japanese patent publication No. 56-24241) and is constructed such that the electromagnetic wave energy transmitting portion thereof is made of unsintered or incompletely sintered expanded polytetrafluoroethylene. The dielectric line proposed has a number of advantages in that it can transmit electromagnetic waves of high energy density with little transmission loss, that it can be easily worked and adjusted as to its dielectric constant when formed, and that it has ample flexibility.

Figure 1:
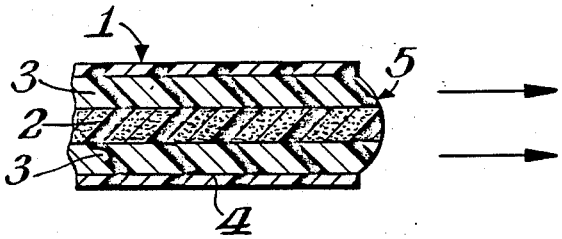
FIGS. 1–10 are illustrations of cross-sections of embodiments of the present invention.

FIG. 1 shows a first embodiment of the present invention, in which a dielectric line 1 has one end portion formed with a convex face 5 at its end. This convex face 5 acts as a convex lens for the electromagnetic waves which are radiated from the end face of the one end portion of the dielectric line so that the electromagnetic waves are radiated in the form of a plane front from the end face of the dielectric line 1.

Figure 2:
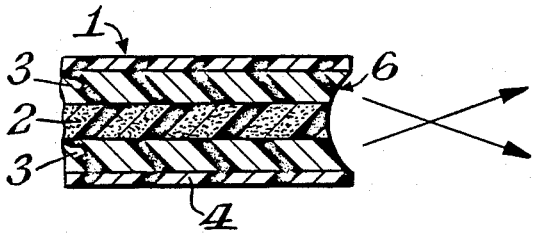

FIG. 2 shows a second embodiment of the present invention in which the dielectric line 1 has its one end portion formed with a concave face 6 at its end.

Figure 3:
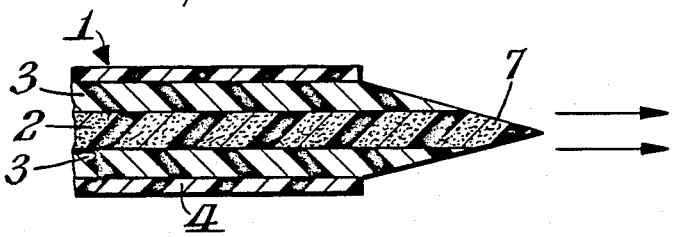

FIG. 3 shows a third embodiment of the present invention in which the dielectric line 1 has its one end portion sharpened to form a conical end portion 7, similar to the tip of a pencil, thereby to develop a plane front.

Figure 4:
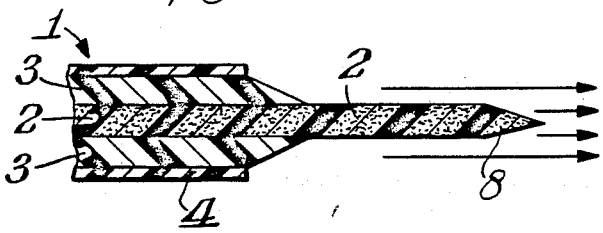

FIG. 4 shows a fourth embodiment of the present invention in which cladding 3 is removed in the vicinity of the one end portion of the dielectric line 1 to expose core 2 to the outside for a distance along the line and in which the core 2 thus exposed has its leading end sharpened to form a conical tip portion 8 thereby to develop a plane front.

Figure 5:
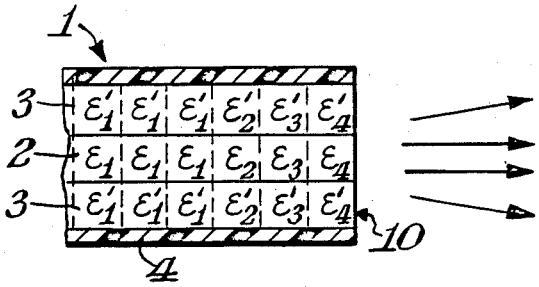

FIG. 5 shows a fifth embodiment of the present invention in which the dielectric line 1 has its end face 10 cut at a right angle with respect to the longitudinal direction thereof and is worked such that its dielectric constant gradually decreases along the axis thereof toward the end face 10. In order to achieve a decreasing dielectric constant along the longitudinal dimension of the expanded polytetrafluoroethylene core, one end of the polytetrafluoroethylene may be restrained while pulling only the other end during the expansion process. By this method, the local expansion ratio will increase along the line and the dielectric constant will decrease. A gradient in sintering temperature may be employed, the dielectric constant decreasing with increasing temperature. Or, for the cladding, decreasing density tape is wrapped longitudinally about the core along the length of the line.

Figure 6:
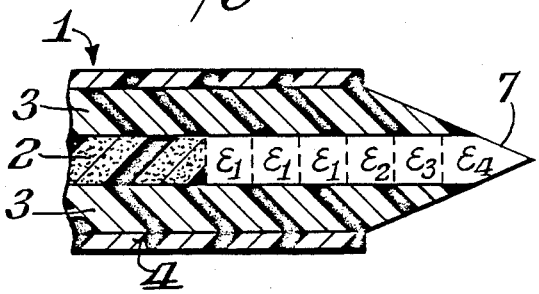
Figure 7:
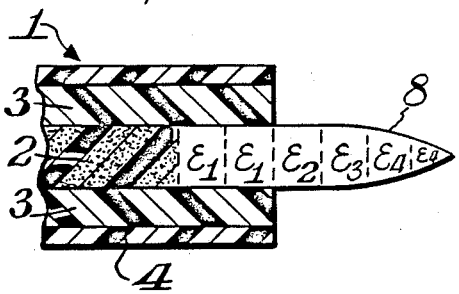

If the unit portions along the axis of the core have decreasing dielectric constants $\epsilon_1$, $E_2$, $\epsilon_3$ and $\epsilon_4$ (in fact, they have continuously decreasing dielectric constant), for example as shown in FIG. 5, the relationships of $\epsilon_1 > \epsilon_2 > \epsilon_3 > \epsilon_4$ hold. On the other hand, not only the core 2 but also the cladding 3 may have such a similar decreasing dielectric constant change as is expressed by the relationships of $\epsilon_{1'} > \epsilon_{2'} > \epsilon_{3'} > \epsilon_{4'}$. Especially if the dielectric constants of the core 2 are so changed as shown in FIG. 5, registration of characteristic impedances with the outside space is improved. This structure having the core 2 of changing dielectric constant is made more effective by the dielectric lines 1 of FIGS. 6 and 7 combined with the structures similar to those of FIGS. 3 and 4.

Here, as has been described hereinbefore, the dielectric substance used to construct the dielectric lines 1 of the respective embodiments of the present invention are made of expanded unsintered or incompletely sintered polytetrafluoroethylene. This material is a highly crystalline high-molecular weight material having an internal structure in which a number of fine nodes are three-dimensionally connected to one another by a number of fine fibrils, leaving a number of complicated voids between nodes and fibrils, thereby forming a porous fine structure having continuous porosity.

The dielectric material having a porous fine structure is prepared by expanding extruded polytetrafluoroethylene (PTFE) in the unsintered state by several up to one hundred times in at least one axial direction in accordance with the method disclosed in Japanese patent publication No. 51-18991, for example. This expanded PTFE product can have its specific gravity, porosity, dielectric constant and other properties varied over a remarkably wide range by changing the rate and degree of stretch. It is possible to produce such a dielectric substance for a transmission line having electromagnetic wave energy propagation properties adjusted as desired. The expanded product is either partly sintered and thermally fixed at a temperature not lower than the melting point (i.e., 327° C.) of the PTFE, preferably at 340° to 380° C., especially at 360° to 375° C. for about 1 to 15 minutes, or fixed and unsintered at a temperature below the melting point but not lower than 250° C. By suitably changing the extent of the sintering or the thermal fixation of that expanded product, the dielectric constant of the porous PTFE can be adjusted as desired, which in turn provides an important step to be used for adjusting the characteristics and performances of the dielectric line 1 of the present invention, together with the steps of changing the percent and rate of stretch.

In addition to the axial change of the dielectric constant of the dielectric line 1, as in the present invention, the lens effect, such as that of the first embodiment shown in FIG. 1, can be attained by changing the dielectric constant of the core 2 in the radial direction.

All the embodiments thus far described are directed to the case in which the dielectric line 1 has one end portion worked so as to have its characteristic impedance gradually approaching that of the space at the end of the line. In a sixth embodiment of the present invention shown in FIG. 8, however, the dielectric line 1 is cut at the end face 10 at its one end portion at a right angle with respect to the longitudinal direction thereof, and a dielectric lens 11 is disposed at a position spaced at a predetermined distance from that end face so that its focal point is located on the end face 10. This dielectric lens 11 is exemplified by a shaped piece of the aforementioned unsintered continuously porous polytetrafluoroethylene resin, as is disclosed in Japanese patent publication No. 59-23483. Owing to the provision of the dielectric lens 11, the electromagnetic waves radiated from the end face 10 of the dielectric line 1 are transformed into a plane front.

Figure 8:
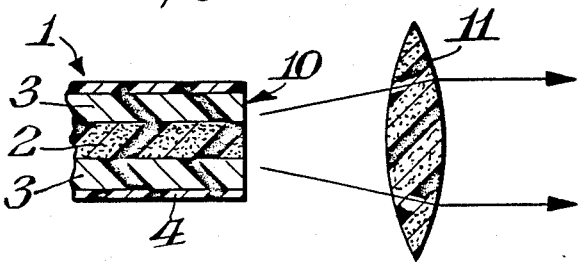
Figure 9:
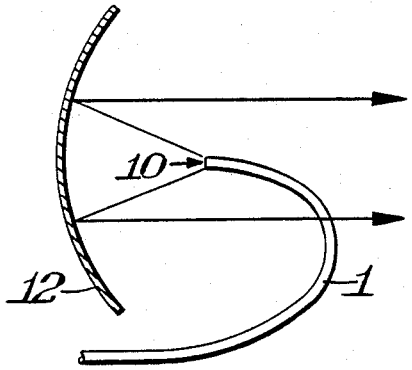
Figure 10:
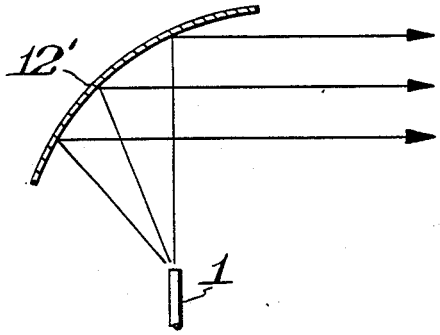

In another embodiment of the present invention shown in FIG. 9, the dielectric lens of FIG. 8 is replaced by a reflector antenna such as a parabolic antenna 12, and the dielectric line 1 is arranged to have its end face 10 located at the focal point of that antenna 12. Although the axially symmetric parabolic antenna 12 is used in FIG. 9, an offset type parabolic antenna 12' may be used, as shown in FIG. 10.

Figure 11:
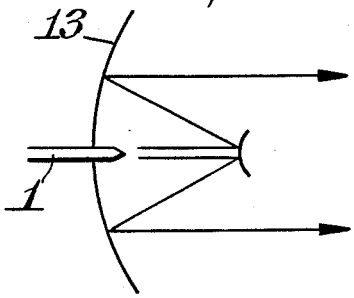
FIGS. 11 through 14 show lines having conically tapered ends as the primary radiator for antennae of the Cassegrain type.
Figure 12:
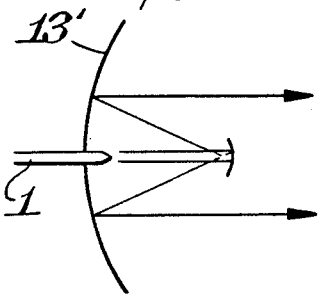
Figure 13:
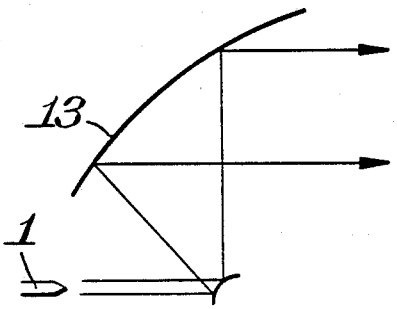
Figure 14:
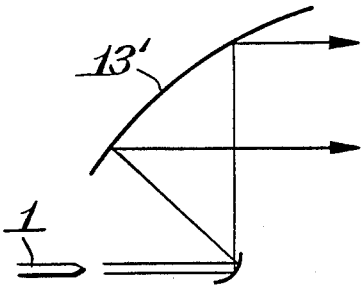
Figure 15:
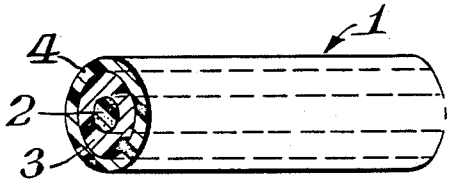
Fig. 15. (Prior Art)
FIG. 15 shows a dielectric transmission line known in the prior art.

Alternatively, the dielectric line 1 having its one end portion formed into a conical shape, for example, as shown in FIG. 3, may be used as the primary radiator for antennae of the Cassegrain type, as shown in FIGS. 11 and 12. FIG. 11 shows the case of the near field Cassegrain antenna 13, whereas FIG. 12 shows the case of the far field Cassegrain antenna 13'. Moreover, FIGS. 13 and 14 show antenna structures 13 and 13' in which the power supply axes of the primary radiators are offset from the axis of the antenna beam.

From the description thus far, the construction and operations of the present invention have been clarified, but the present invention can also be applied to a dielectric line of either the step index type or the graded index type, and the dielectric line may have not only a circular cross section but an elliptic or square cross section as well. Here, the circular section is more suitable in case the plane or polarization is turned or changed, and the square section is more suitable in case a vertical or horizontal plane of polarization is to be formed.

Moreover, the dielectric line may be equipped with either a boundary condition setting portion of a shield portion made of metal and, further, with an absorptive layer made of a conductive resin.

In case the electromagnetic waves to be radiated from the one end portion of the dielectric line need not be the plane front in the present invention, the object can be achieved by means of a dielectric line which has its end face cut at a right angle with respect to the longitudinal axis, for example.

The following several effects are achieved according to the present invention:

(1) Because there is no joint portion with a metallic waveguide, it is possible to substantially eliminate an increase in the insertion loss, and reflection and a narrowness of the frequency band as has been caused in that joint portion in the prior art;

(2) The wave plane front can be radiated from the end face of the dielectric line merely by making the shape of the end face suitable, and the radiation angle can be freely controlled for the object intended;

(3) When the waveguide passage is present in front of the reflector, as in the reflector antenna, there can arise a defect in that the metallic waveguide will reflect the electromagnetic waves. In case the dielectric line of the present invention is used, by removing its jacket and metallic shield layer to expose the core and the cladding only, or only the core, as the case may be, most of the electromagnetic waves radiated from the reflector antenna pass through that dielectric line so that little spuriousness wave loss results; and (4) Even if the plane of polarization is not held within the dielectric line, the electromagnetic waves can be effectively radiated.

While the invention has been disclosed herein in connection with certain embodiments and detailed descriptions, it will be clear to one skilled in the art that modifications or variations of such details can be made without deviating from the gist of this invention, and such modifications or variations are considered to be within the scope of the claims hereinbelow.

What is claimed is:

1. A dielectric transmission line for transmitting electromagnetic waves into free space comprising:

a core of expanded, porous polytetrafluoroethylene, said core having a non-metallic cladding thereover, one end portion of said transmission line configured to emit electromagnetic waves directly into free space, said core having a decreasing dielectric constant proceeding axially toward said one end portion, and said cladding having a decreasing dielectric constant proceeding axially toward said one end portion.

2. The transmission line of claim 1 wherein said one end portion is configured to a convex shape.

3. The transmission line of claim 1 wherein said one end portion is configured to a concave shape.

4. The transmission line of claim 1 wherein said core is unsintered polytetrafluoroethylene.

5. The transmission line of claim 1 wherein said core is partially sintered polytetrafluoroethylene.

* * * * *